US009074609B2

(12) United States Patent
Zhang et al.

(10) Patent No.: US 9,074,609 B2
(45) Date of Patent: Jul. 7, 2015

(54) GAS TURBINE ENGINE

(75) Inventors: Jiping Zhang, Winter Springs, FL (US); Kevin M. Light, Maitland, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1140 days.

(21) Appl. No.: 13/027,366

(22) Filed: Feb. 15, 2011

(65) Prior Publication Data

US 2012/0204574 A1 Aug. 16, 2012

(51) Int. Cl.

| | |
|---|---|
| ***F04D 29/54*** | (2006.01) |
| ***F01D 5/08*** | (2006.01) |
| ***F01D 11/24*** | (2006.01) |
| ***F01D 9/04*** | (2006.01) |
| ***F01D 9/06*** | (2006.01) |
| ***F04D 29/58*** | (2006.01) |

(52) U.S. Cl.

CPC ..... *F04D 29/542* (2013.01); *F01D 5/081* (2013.01); *F01D 11/24* (2013.01); *F01D 9/041* (2013.01); *F01D 9/065* (2013.01); *F04D 29/584* (2013.01); *F05D 2260/20* (2013.01); *F05D 2240/12* (2013.01)

(58) Field of Classification Search

CPC ..... F02C 7/16; F02C 7/18; Y02T 50/676; F01D 11/24; F01D 5/081; F01D 5/087

USPC ..... 60/782, 805, 806, 39.83; 415/115, 180, 415/171.1, 170.1

See application file for complete search history.

(56) References Cited

U.S. PATENT DOCUMENTS

| | | | | |
|---|---|---|---|---|
| 3,565,545 | A * | 2/1971 | Bobo et al. | 16/90 R |
| 3,734,639 | A * | 5/1973 | Short | 415/114 |
| 3,989,410 | A * | 11/1976 | Ferrari | 415/115 |
| 4,199,154 | A | 4/1980 | Mueller | |
| 4,217,755 | A * | 8/1980 | Williams | 60/806 |
| 4,296,599 | A * | 10/1981 | Adamson | 60/39.23 |
| 4,581,300 | A * | 4/1986 | Hoppin et al. | 428/546 |
| 4,587,700 | A * | 5/1986 | Curbishley et al. | 29/889.2 |
| 4,820,116 | A * | 4/1989 | Hovan et al. | 415/115 |
| 4,882,902 | A * | 11/1989 | Reigel et al. | 60/806 |
| 5,218,816 | A * | 6/1993 | Plemmons et al. | 60/806 |
| 5,402,636 | A * | 4/1995 | Mize et al. | 60/806 |
| 5,724,806 | A * | 3/1998 | Horner | 60/785 |
| 6,682,077 | B1 | 1/2004 | Letourneau | |
| 7,211,906 | B2 | 5/2007 | Teets et al. | |
| 7,870,742 | B2 * | 1/2011 | Lee et al. | 60/782 |
| 2002/0067987 | A1 * | 6/2002 | Toborg et al. | 415/170.1 |

(Continued)

OTHER PUBLICATIONS

Moroz, L and Tarasov, A.; Flow Phenomenon in Steam Turbine Disk-Stator Cavities Channeled by Balance Holes; Proceedings of ASME Turbo Expo 2004; Power for Land, Sea, and Air; Jun. 14-17, 2004; Vienna, Austria.

(Continued)

*Primary Examiner* — Gerald L Sung

(57) ABSTRACT

A power turbine receiving cooling fluid from compressor apparatus is provided. The turbine comprises: fixed housing structure; a support shaft rotatably supported in the housing structure; at least one disk overhung on the support shaft and coupled to the support shaft so as to rotate with the support shaft; and cooling fluid structure. The at least one disk is formed from a low-alloy-content steel. The cooling fluid supply structure extends through the support shaft and the at least one disk so as to supply cooling fluid to the at least one disk.

18 Claims, 10 Drawing Sheets

(56) References Cited

U.S. PATENT DOCUMENTS

| | | | | |
|---|---|---|---|---|
| 2004/0018081 | A1 | 1/2004 | Anderson, Jr. et al. | |
| 2005/0235651 | A1* | 10/2005 | Morris et al. | 60/782 |
| 2005/0268619 | A1* | 12/2005 | Ress | 60/782 |
| 2010/0058801 | A1 | 3/2010 | Masani et al. | |

OTHER PUBLICATIONS

GE Energy; LMS100 Flexible Power; www.ge-energy.com/lms100; GEA-14355A; Sep. 2006.

* cited by examiner

GAS TURBINE ENGINE

FIELD OF THE INVENTION

The present invention relates to an industrial gas turbine engine comprising compressor apparatus and a power turbine receiving cooling fluid from the compressor apparatus.

BACKGROUND OF THE INVENTION

An industrial gas turbine engine is known comprising compressor apparatus and a power turbine coupled to a shaft of a generator. The power turbine may comprise a rotatable support shaft and a disk overhung on the support shaft. A plurality of blades are coupled to the disk. The disk is believed to be formed from an expensive high-alloy-content material having high temperature capabilities.

SUMMARY OF THE INVENTION

In accordance with a first aspect of the present invention, a power turbine receiving cooling fluid from compressor apparatus is provided. The turbine comprises: fixed housing structure; a support shaft rotatably supported in the housing structure; at least one disk overhung on the support shaft and coupled to the support shaft so as to rotate with the support shaft; and cooling fluid structure. The at least one disk is formed from a low-alloy-content steel. The cooling fluid supply structure extends through the support shaft and the at least one disk so as to supply cooling fluid to the at least one disk.

The at least one disk may comprise first and second disks overhung on the support shaft and coupled to the support shaft so as to rotate with the support shaft. The first and second disks may be formed from a low-alloy-content steel, such as AISI 4340 steel.

A plurality of circumferentially spaced apart bolts may be provided for coupling the first and second disks to the support shaft.

The cooling fluid supply structure may comprise: at least one first convey conduit extending to the fixed housing structure for providing cooling fluid from a first stage of the compressor apparatus to the fixed housing structure; a first plenum formed between the fixed housing structure and the support shaft; at least one first supply passage in the fixed housing structure through which the first stage cooling fluid passes to the first plenum; and first delivery structure formed in the support shaft and the first and second disks so as to provide the first stage cooling fluid to at least one of the first and second disks.

The first plenum, in the illustrated embodiment, extends circumferentially about 360 degrees.

The first delivery structure may comprise a plurality of circumferentially spaced apart delivery passages extending from the first plenum through the support shaft, the second disk and the first disk to a first outer surface of the first disk for providing the first stage cooling fluid to the first outer surface of the first disk.

First and second sealing structures may be associated with the fixed housing structure and the support shaft for sealing the first plenum. The first and second sealing structures may comprise first and second labyrinth sealing structures.

The cooling fluid supply structure may further comprise: at least one second convey conduit extending to the fixed housing structure for providing cooling fluid from a second stage of the compressor apparatus to the fixed housing structure; a second plenum formed between the fixed housing structure and the support shaft; at least one second supply passage in the fixed housing structure through which the second stage cooling fluid passes to the second plenum; and second delivery structure formed in the support shaft and the first and second disks so as to provide the second stage cooling fluid to at least one of the first and second disks.

In the illustrated embodiment, the second plenum extends circumferentially about 360 degrees.

The second delivery structure may comprise: at least one first delivery passageway extending from the second plenum for providing a portion of the second stage cooling fluid to a first outer cavity between the first and second disks; and at least one second delivery passageway extending from the second plenum for providing a portion of the second cooling fluid to a first inner cavity between the first and second disks.

The second delivery structure may further comprise at least one third delivery passageway extending from the second plenum for providing a portion of the second stage cooling fluid to a second inner cavity between the second disk and the support shaft.

The second delivery structure may further comprise: at least one first exit passageway extending between the first inner cavity and the first outer cavity so as to provide a path for cooling fluid in the first inner cavity to travel to the first outer cavity; and at least one second exit passageway extending between the second inner cavity to the first outer cavity so as to provide a path for cooling fluid in the second inner cavity to travel to the first outer cavity.

A third sealing structure may be provided between the housing structure and the support shaft. The second and third sealing structures may seal the second plenum. The third sealing structure may comprise a third labyrinth sealing structure.

In accordance with a second aspect of the present invention, a power turbine is provided for receiving cooling fluid from compressor apparatus comprising: fixed housing structure; a support shaft rotatably supported in the housing structure; and at least one disk overhung on the support shaft and coupled to the support shaft so as to rotate with the support shaft. The at least one disk may be formed from a low-alloy-content steel.

The at least one disk may comprise first and second disks overhung on the support shaft and coupled to the support shaft so as to rotate with the support shaft. The first and second disks may be formed from a low-alloy-content steel, such as AISI 4340 steel.

DETAILED DESCRIPTION OF THE INVENTION

Figure 1:
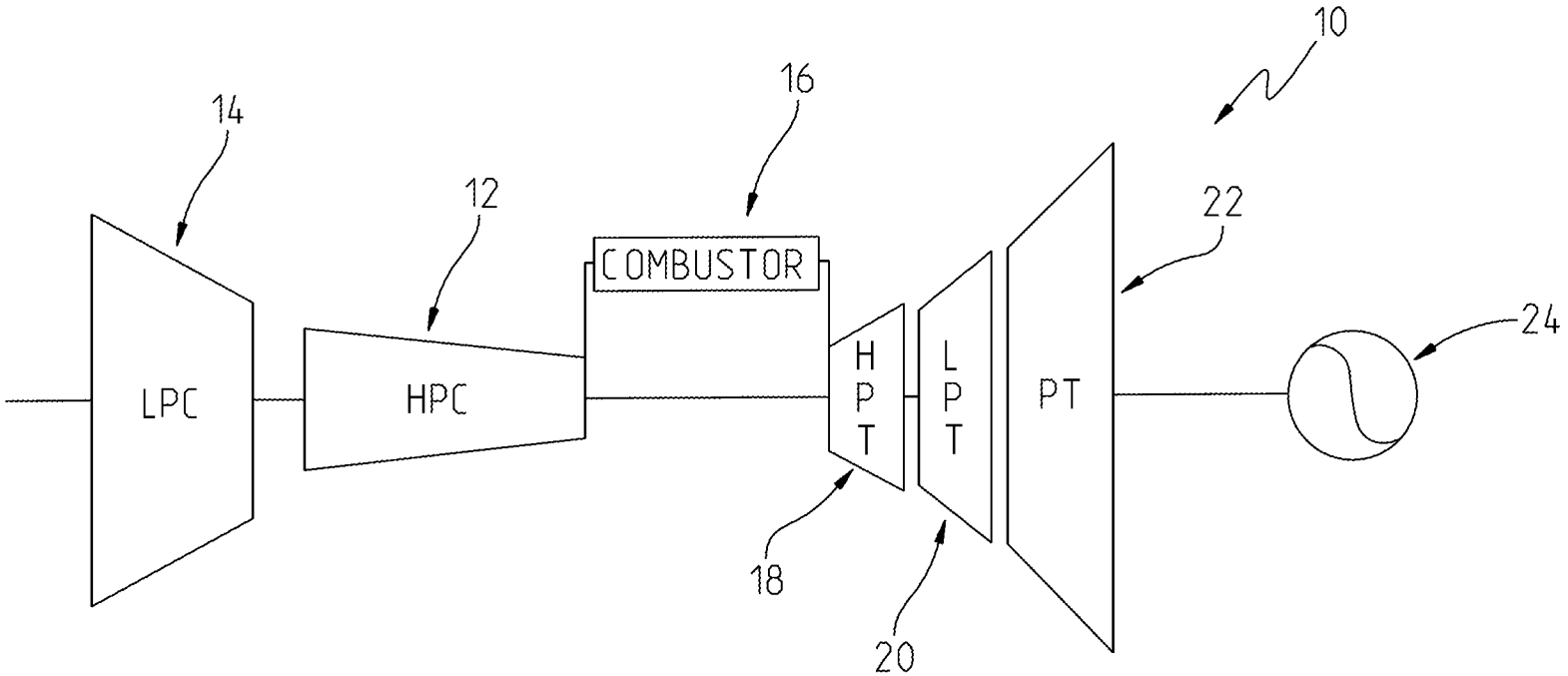
FIG. 1 is a schematic illustration of an aeroderivative industrial gas turbine engine.

FIG. 1 schematically illustrates an aeroderivative industrial gas turbine engine 10 comprising a high pressure compressor 12, a low pressure compressor 14, a combustor 16, a high pressure turbine 18, a low pressure turbine 20, a power turbine 22 and an electric generator 24. The high pressure compressor 12 compresses ambient air to generate high pressure air, e.g., compressed air having a pressure of from about 4 atm to about 20 atm, and the low pressure compressor 14 compresses ambient air to generate low pressure air, e.g., compressed air having a pressure of from about 1 atm to about 4 atm. The high and low pressure compressors 12 and 14 are referred to herein as compressor apparatus. The high pressure compressor 12 is referred to herein as a first stage of the compressor apparatus and the low pressure compressor is referred to herein as a second stage of the compressor apparatus.

The combustor 16 combines a portion of the high pressure compressed air with a fuel and ignites the mixture creating combustion products defining a working gas. The working gases travel to the high pressure turbine 18, the low pressure turbine 20 and the power turbine 22. Within each turbine 18, 20 and 22 are rows of stationary vanes and rotating blades. For each row of blades, a separate disk is provided. The disks (not shown) forming part of the high pressure turbine 18 are coupled to a first rotatable shaft portion (not shown), which is coupled to the high pressure compressor 12 to drive the high pressure compressor 12. The disks (not shown) forming part of the low pressure turbine 20 are coupled to a second rotatable shaft portion (not shown), see FIG. 1, which is coupled to the low pressure compressor 14 to drive the low pressure compressor 14. The second rotatable shaft portion is positioned within and co-axial with the first rotatable shaft portion. As the working gases expand through the turbines 18 and 20, the working gases cause the rows of rotatable blades within the turbines 18 and 20, and therefore the first and second shaft portions, to rotate.

Figure 2:
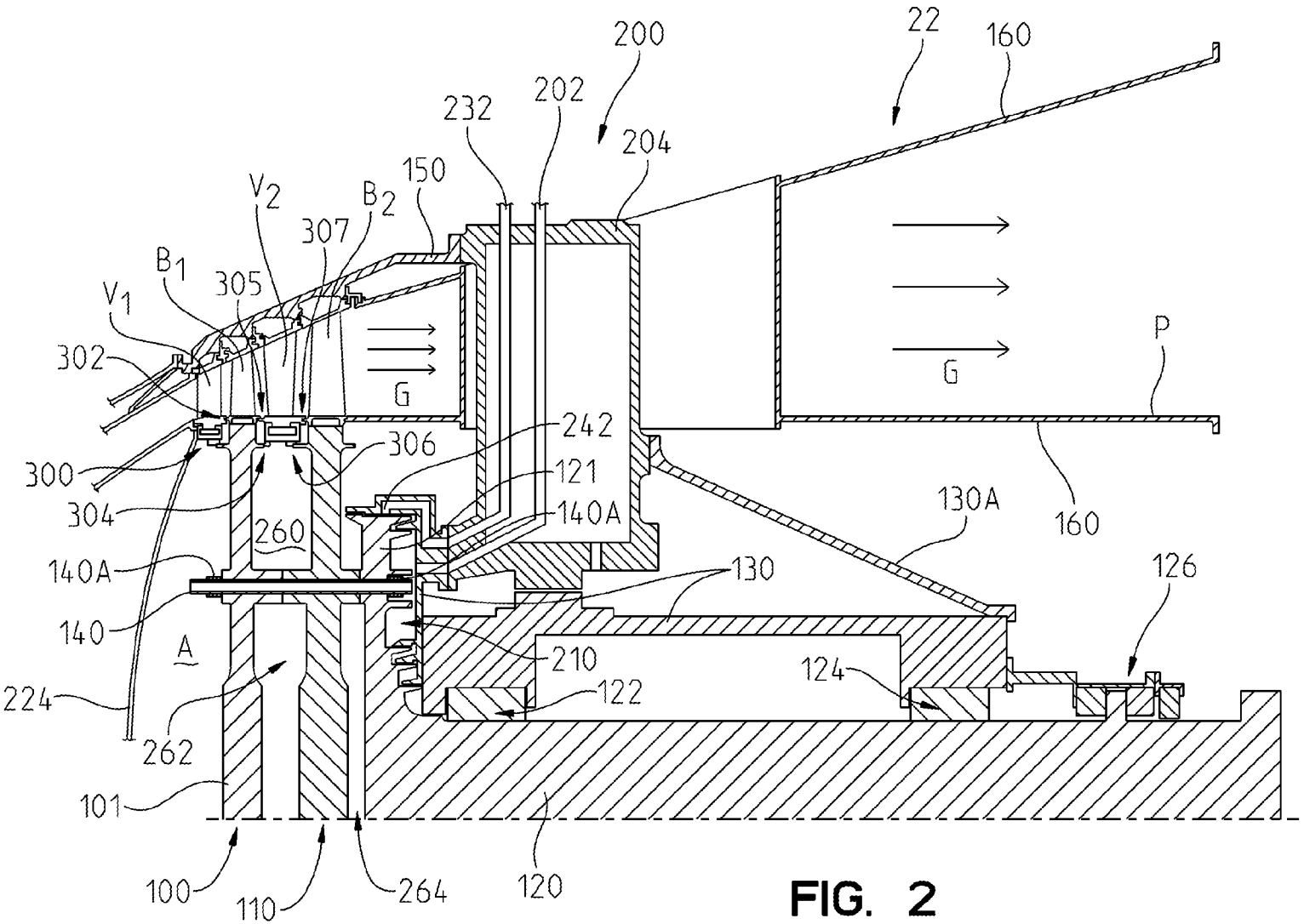
FIG. 2 is a view, partially in cross section, of a portion of a power turbine in the engine illustrated in FIG. 1.

First and second disks 100 and 110 of the power turbine 22 are coupled to a rotatable support shaft 120, which is also coupled to the electric generator 24 so as to drive the electric generator 24, see FIG. 2. As the working gases expand through the power turbine 22, the working gases apply forces to two rows of rotatable first and second blades $B_1$ and $B_2$, coupled respectfully to the first and second disks 100 and 110, thereby causing the first and second disks 100 and 110 to rotate. The support shaft 120 rotates with the first and second disks 100 and 110.

The power turbine 22 further comprises a fixed housing structure 130, see FIG. 2. The rotatable support shaft 120 is rotatably supported within the housing structure 130 via first and second journal bearings 122 and 124. A thrust bearing 126 is further coupled between the rotatable support shaft 120 and the housing structure 130 so as apply an axial force onto the support shaft 120 to counter axial forces applied against the first and second blades $B_1$ and $B_2$ coupled to the first and second disks 100 and 110, see FIG. 2. In the embodiment illustrated in FIG. 2, a first row of first vanes $V_1$ is provided, then the first row of the rotatable first blades $B_1$ is provided, then a second row of second vanes $V_2$ is provided, followed by the second row of the rotatable second blades $B_2$.

Figure 3:
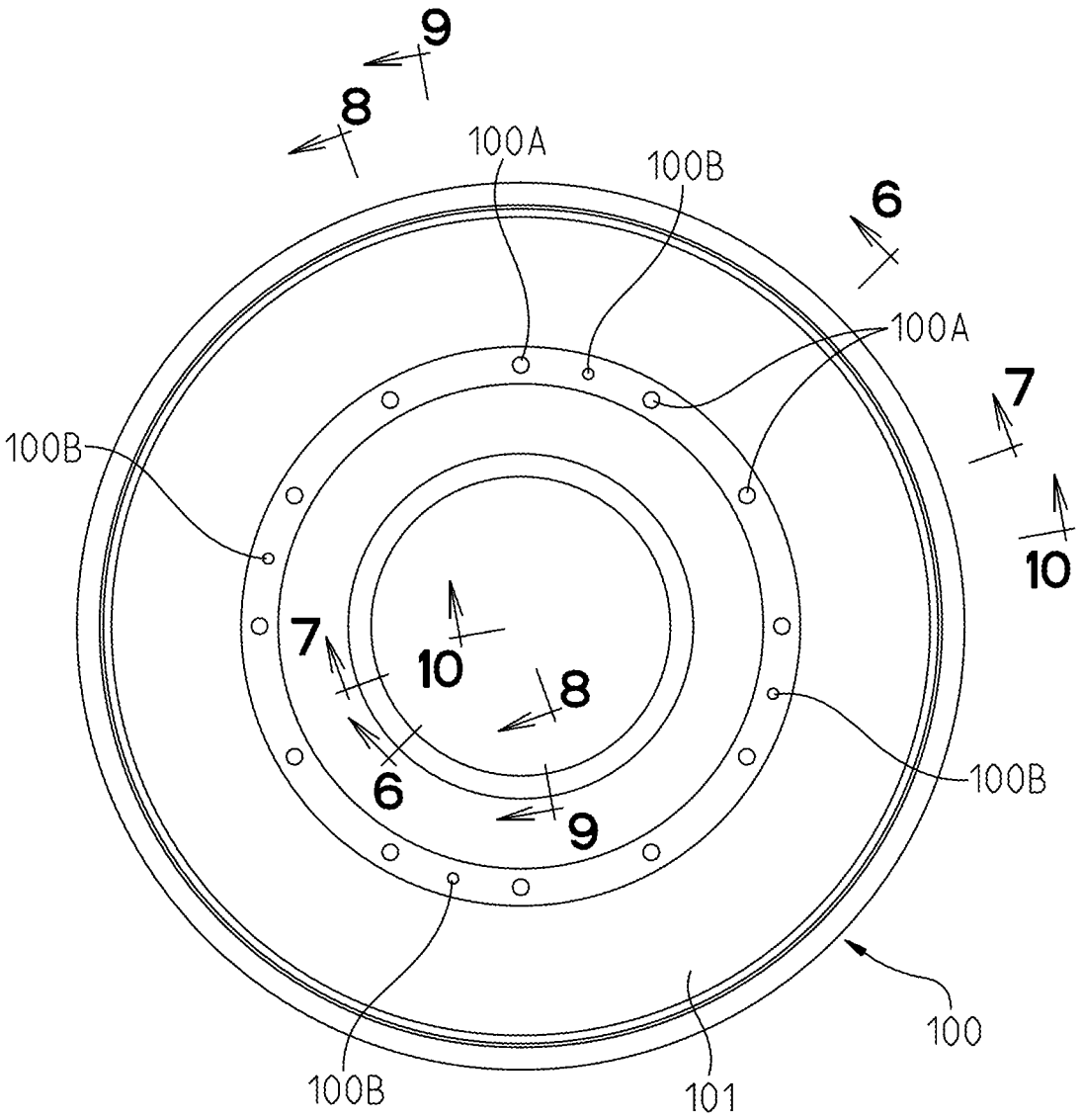
FIG. 3 is a view of a first outer surface of a first disk forming part of the power turbine, wherein a second disk and a rotatable support shaft are positioned behind the first disk.
Figure 4:
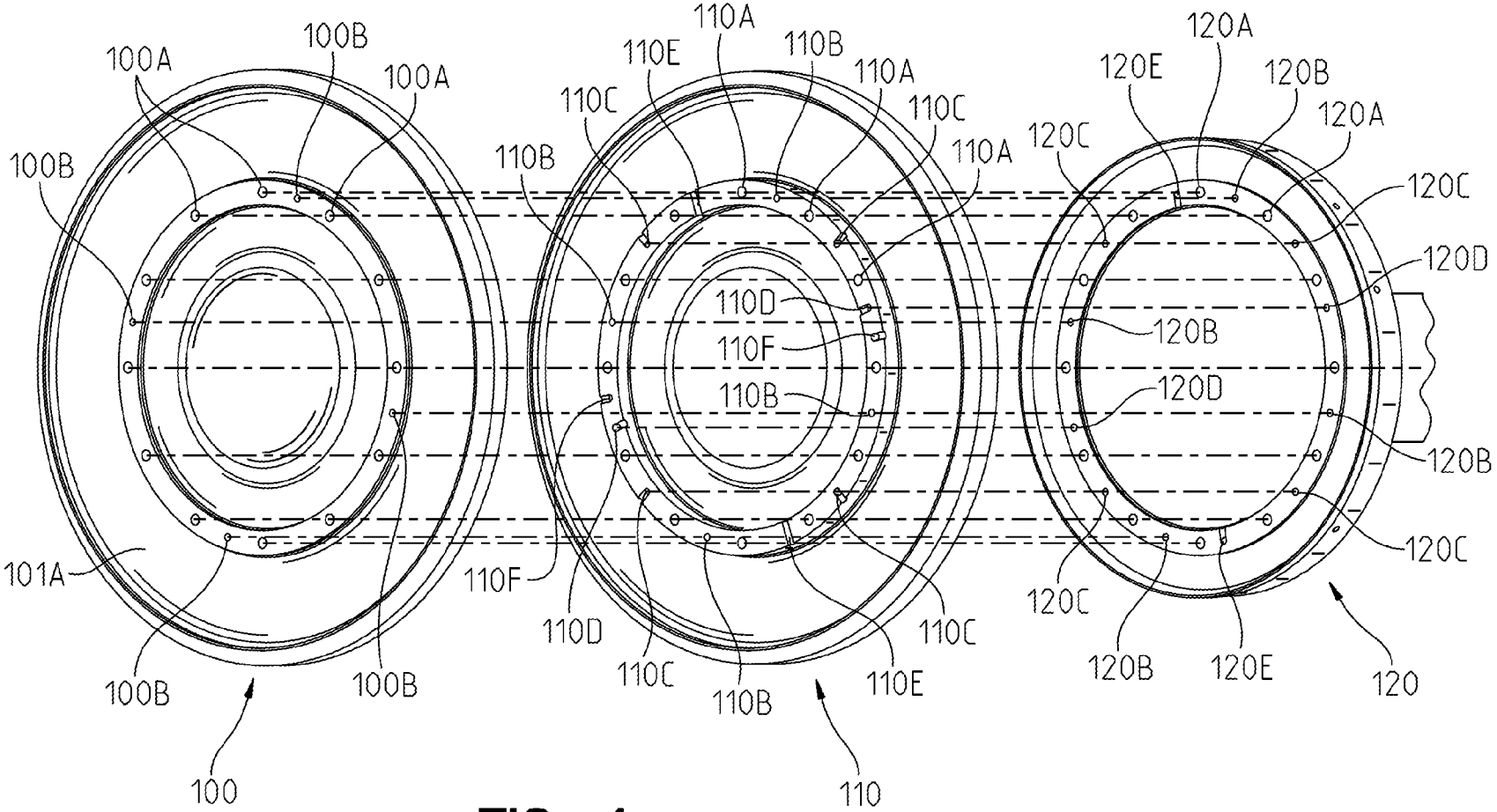
FIGS. 4 and 5 are perspective views of the first disk, the second disk and the rotatable support shaft forming part of the power turbine.
Figure 5:
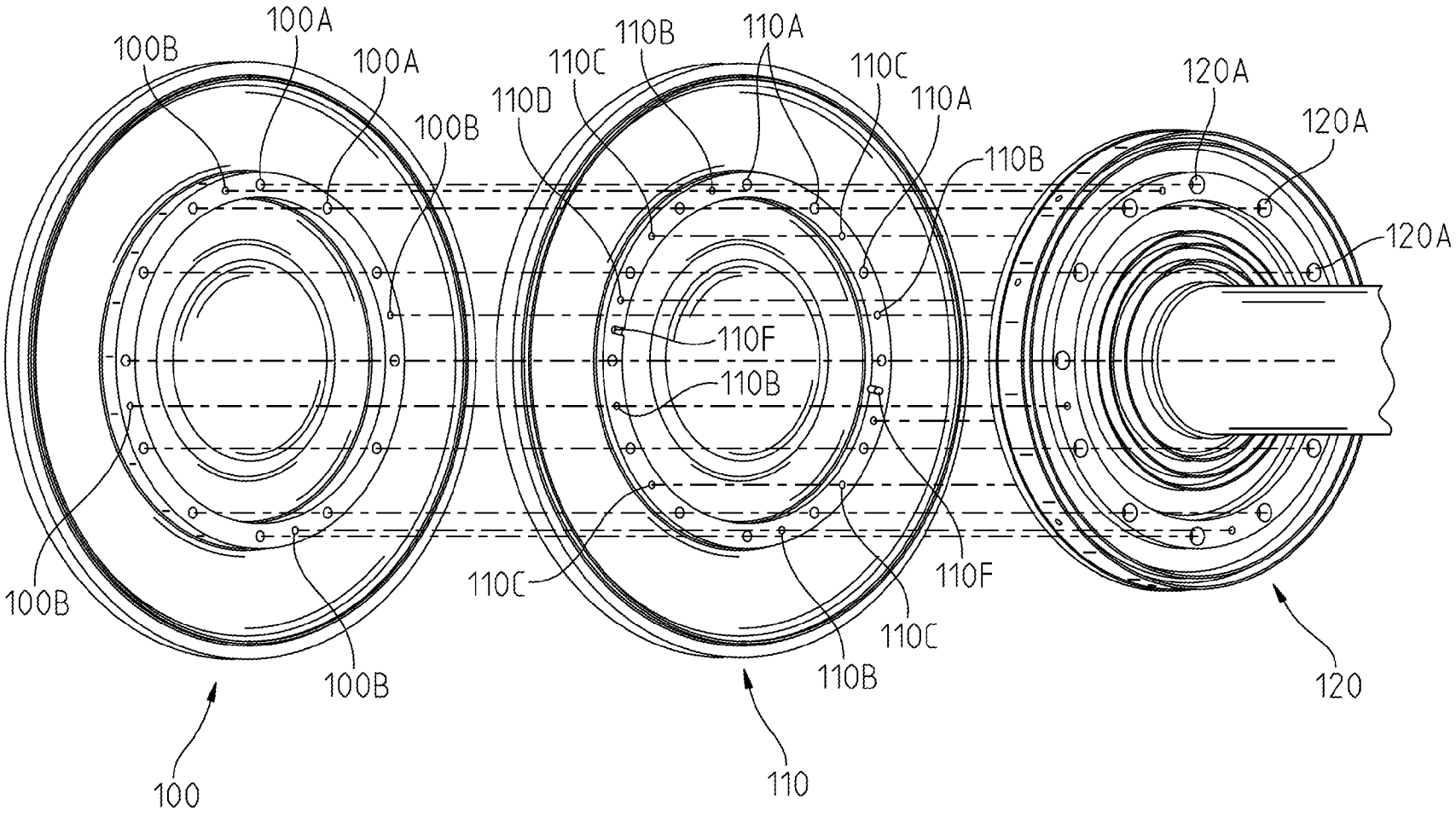
Figure 6:
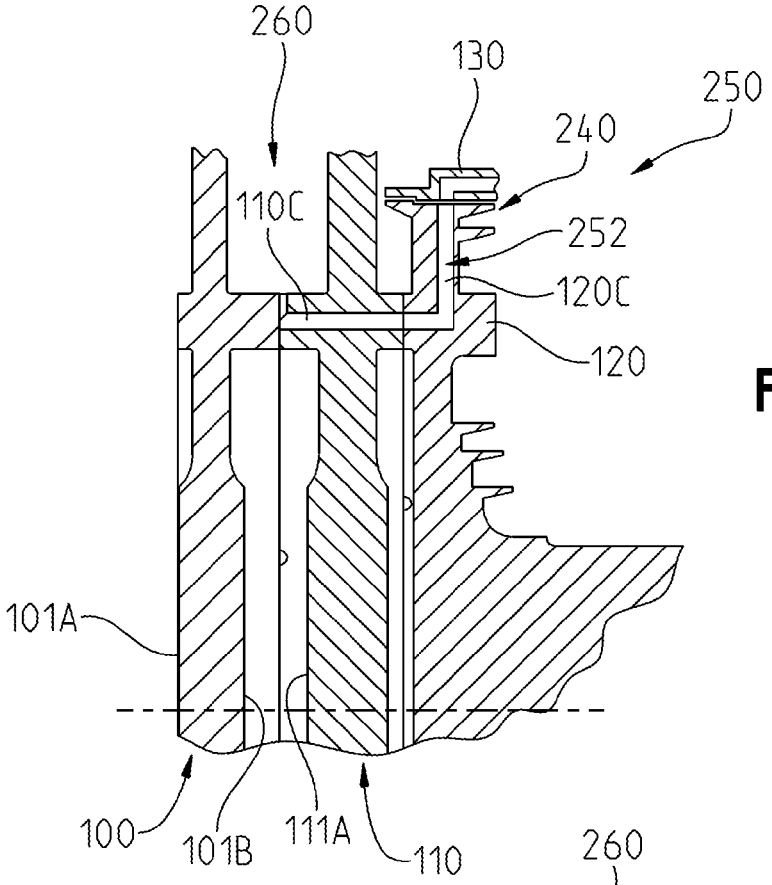
FIG. 6 is a view taken along view line 6-6 in FIG. 3.
Figure 7:
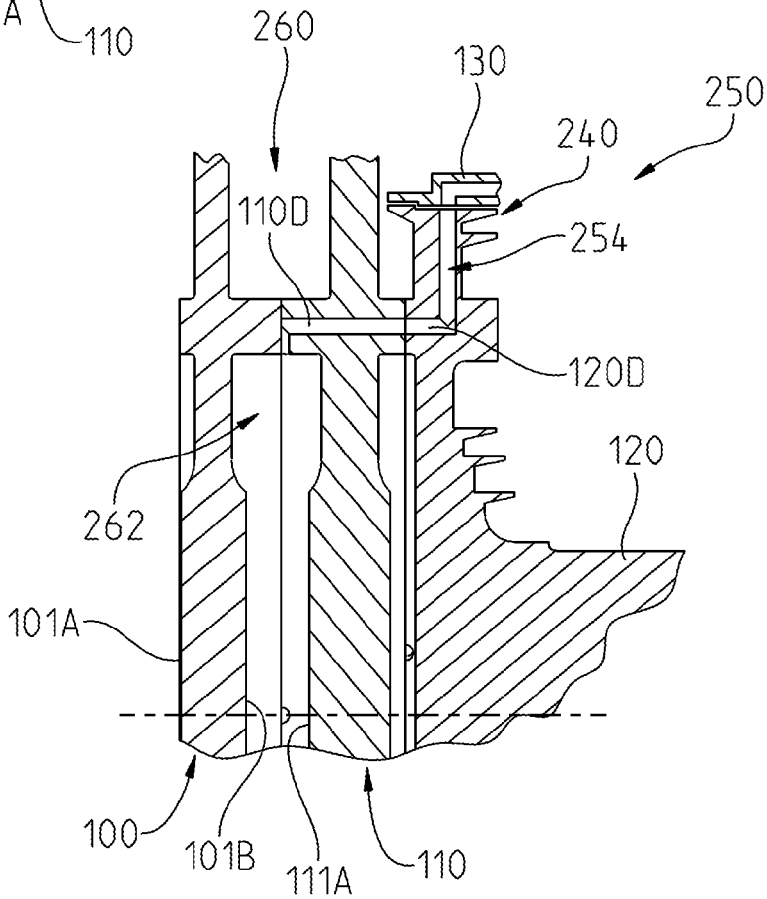
FIG. 7 is a view taken along view line 7-7 in FIG. 3.

The first and second disks 100 and 110 are overhung on the support shaft 120, i.e., are coupled to the support shaft 120 outside of rather than between the first and second journal bearings 122 and 124. In the illustrated embodiment, twelve bolts 140, circumferentially positioned 30 degrees apart, extend through bolt receiving bores 120A in a radially extended section 121 of the support shaft 120, bolt receiving bores 110A in the second disk 110 and bolt receiving bores 100A in the first disk 100, see FIGS. 2-5 and 11 (bolts are not illustrated in FIGS. 3-5). A pair of corresponding nuts 140A are provided for and coupled to each bolt 140, see FIGS. 2 and 11.

In the illustrated embodiment, the first and second disks 100 and 110 are formed from a low-alloy-content steel, such as AISI 4340 steel. As will be discussed further below, the power turbine 22 further comprises cooling fluid supply structure 200, which functions to cool the first and second disks 100 and 110, thereby allowing the disks 100 and 110 to be formed from a less expensive, low-alloy-content steel rather than a more expensive, high-alloy-content steel.

Figure 11:
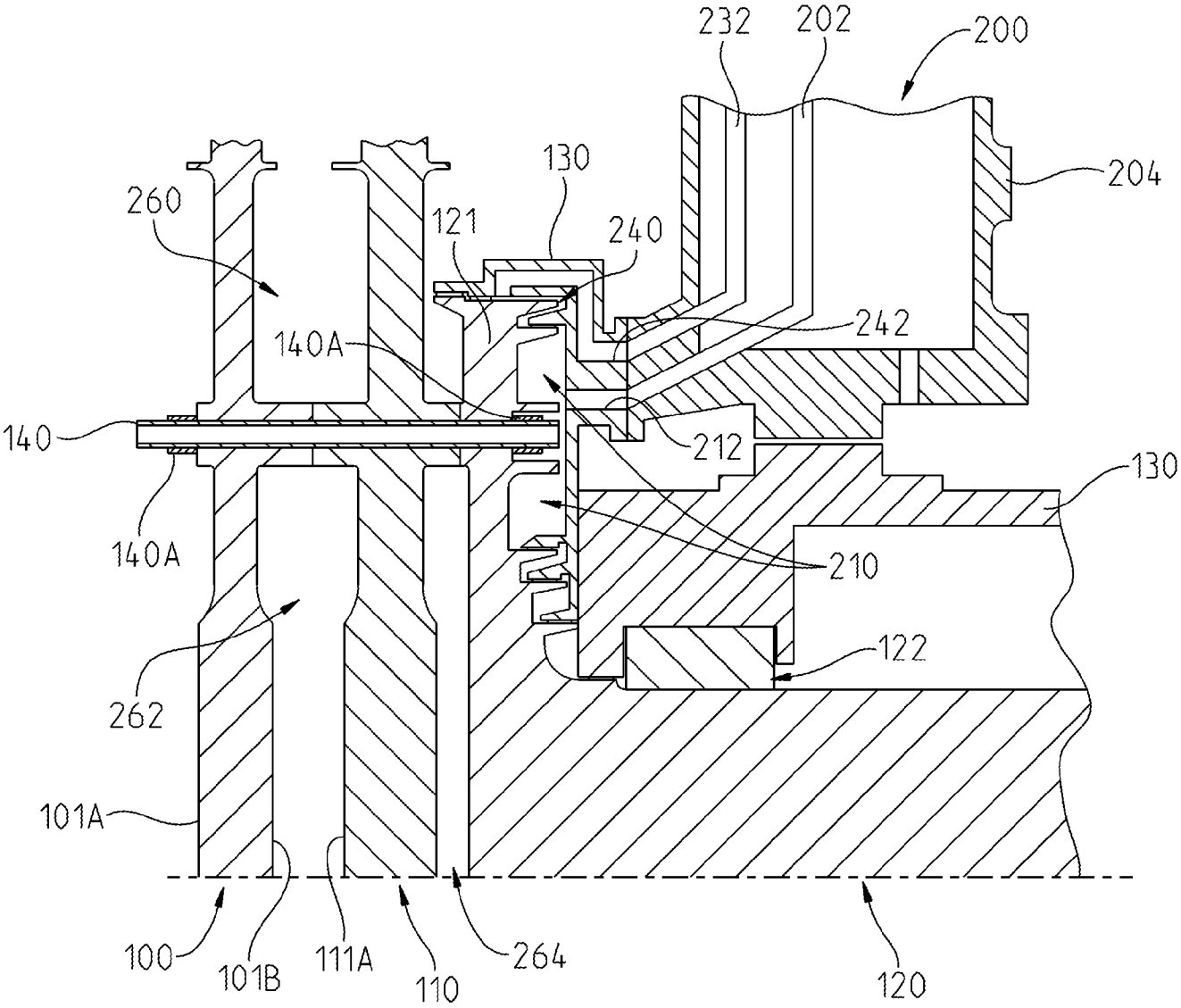
FIG. 11 is a view, partially in cross section, of a portion of a power turbine in the engine illustrated in FIG. 1 and illustrating bolts coupling together the first disk, the second disk and the rotatable support shaft.

In the illustrated embodiment, the cooling fluid supply structure 200 comprises a plurality of circumferentially spaced-apart first fixed convey conduits 202, each extending to the fixed housing structure 130, see FIGS. 2 and 11. Each conduit 202 extends through a corresponding strut 204, which strut 204 is fixed to the housing structure 130 via brackets 130A, see FIG. 2. Each strut 204 is also fixed to a turbine outer casing 150, see FIG. 2. A strut shield 204A encases a corresponding strut 204 so as to protect the strut 204 from hot gases G passing through a working passage P located between the outer casing 150 and a diffuser 160.

The first convey conduits 202 provide cooling fluid from the high pressure compressor 12 to the fixed housing structure 130. A first plenum 210 is formed between the fixed housing structure 130 and the support shaft 120. A plurality of first supply passages 212 are formed in the fixed housing structure 130. Each first supply passage 212 communicates with a corresponding one of the first convey conduits 202 and the first plenum 210 and defines a path for high pressure cooling fluid or air to travel from the corresponding first convey conduit 202 to the first plenum 210, see FIG. 11. The first plenum 210, in the illustrated embodiment, extends circumferentially about 360 degrees. The high pressure cooling air received in the first plenum 210 is used for cooling a first outer surface 101A of the first disk 100, as will be discussed below, and further functions to provide an axial force to the support shaft 120, thereby reducing axial forces applied by the support shaft 120 to the thrust bearing 126.

First and second sealing structures 213 and 214 are associated with the fixed housing structure 130 and the support shaft 120 for sealing the first plenum 210. The first and second sealing structures 213 and 214 comprise, respectfully, in the illustrated embodiment, first and second labyrinth sealing structures 213A and 214A.

Figure 12:
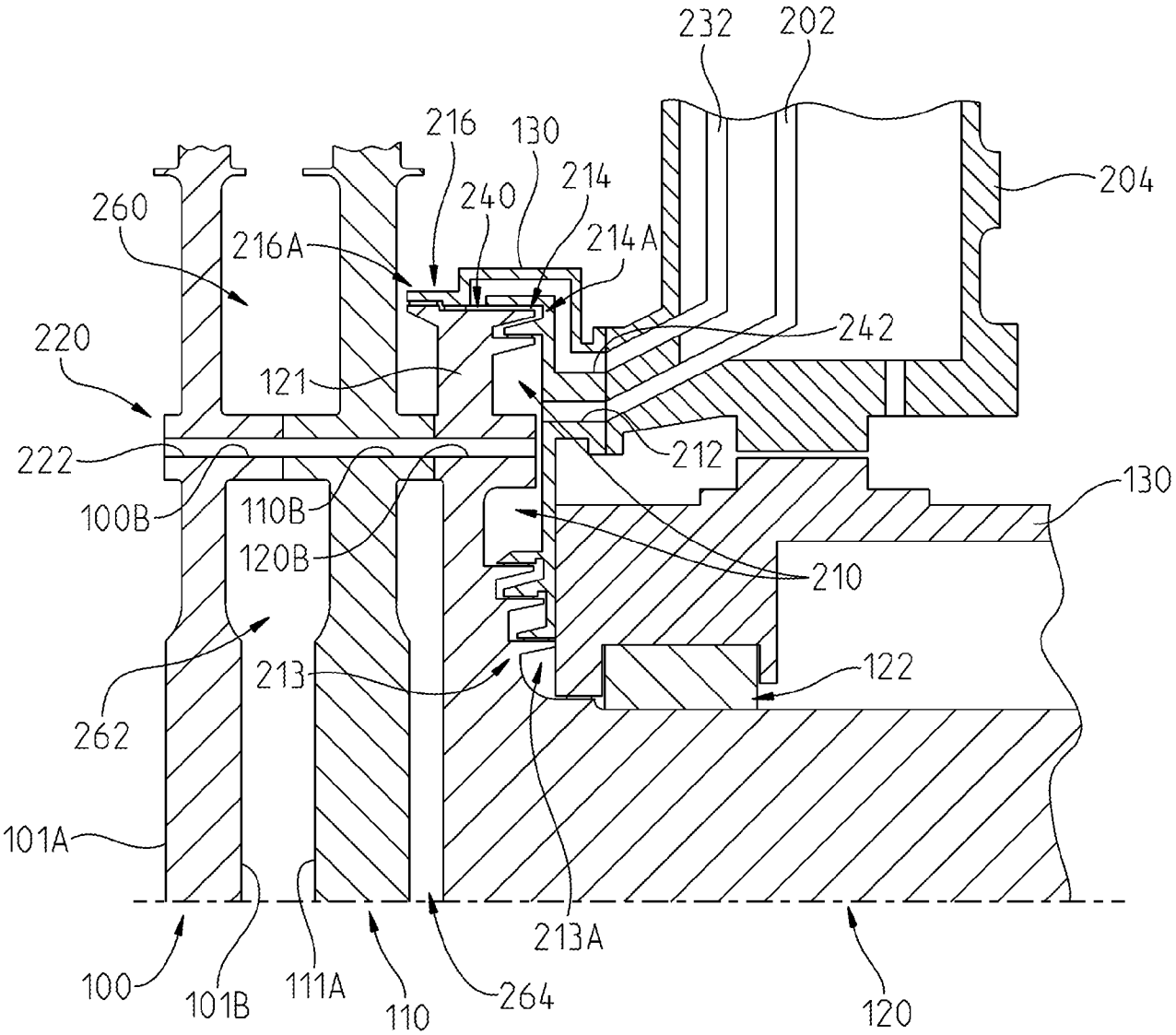
FIG. 12 is a view, partially in cross section, of a portion of a power turbine in the engine illustrated in FIG. 1 and illustrating a delivery passage extending from a first plenum, through the support shaft, the second disk and the first disk to the first outer surface of the first disk.

The cooling fluid supply structure 200 further includes first delivery structure 220 comprising, in the illustrated embodiment, four circumferentially spaced apart delivery passages 222 extending from the first plenum 210, through the support shaft 120, the second disk 110 and the first disk 100, to the first outer surface 101A of the first disk 100, see FIG. 12. Each delivery passage 222 is defined by a passage bore 120B in the radially extended section 121 of the support shaft 120, a passage bore 110B in the second disk 110 and passage bore 100B in the first disk 100, see FIGS. 3-5 and 12. In the illustrated embodiment, the delivery passages 222 have a diameter of about 30 mm. The delivery passages 222 function to provide high pressure cooling air to an area A defined by the first outer surface 101A of the first disk 100 and a stationary shield 224, see FIG. 2. Hence, the high pressure cooling air cools the first outer surface 101A of the first disk 100. Preferably, the high pressure cooling air has a pressure greater than the pressure of the hot gases G flowing through the working passage P so as to prevent hot gases from passing through first and second conventional sealing structure 300 and 302 between the first row of vanes $V_1$ and the first disk 100 and between the first row of vanes $V_1$ the first row of blades $B_1$.

The cooling fluid supply structure 200 also comprises a plurality of circumferentially spaced-apart second fixed convey conduits 232, each extending to the fixed housing structure 130, see FIGS. 2 and 11. Each conduit 232 extends through a corresponding strut 204. The second convey conduits 232 provide cooling fluid or air from the low pressure compressor 14 to the fixed housing structure 130.

A second plenum 240 is formed between the fixed housing structure 130 and the support shaft 120, see FIGS. 2, 11 and 12. A plurality of second supply passages 242 are formed in the fixed housing structure 130. Each second supply passage 242 communicates with a corresponding one of the second convey conduits 232 and the second plenum 240 and defines a path for low pressure cooling air to travel from the corresponding second convey conduit 232 to the second plenum 240, see FIG. 11. The second plenum 240, in the illustrated embodiment, extends circumferentially about 360 degrees.

A third sealing structure 216 may be provided between the fixed housing structure 130 and the support shaft 120. In the illustrated embodiment, the third sealing structure 216 may comprise a third labyrinth sealing structure 216A. The second and third sealing structures 214 and 216 seal the second plenum 240.

Second delivery structure 250 is formed in the support shaft 120 and the first and second disks 100 and 110 so as to provide the low pressure cooling air to the first and second disks 100 and 110.

The second delivery structure 250 comprises, in the illustrated embodiment, four first delivery passageways 252 extending from the second plenum 240 for providing a portion of low pressure cooling fluid to a first outer cavity 260 located between the first and second disks 100 and 110, see FIGS. 2, 6, 11 and 12. Each first delivery passageway 252 is defined by a first delivery bore 120C provided in the support shaft 120 and a first delivery bore 110C provided in the second disk 110, see FIGS. 3-6. In the illustrated embodiment, the first delivery passageways 252 have a diameter of about 25 mm. The low pressure cooling air delivered by the first delivery passageways 252 cools an outer section of the second outer surface 101B of the first disk 100 and an outer section of the first outer surface 111A of the second disk 110. Preferably, the low pressure cooling air has a pressure greater than the pressure of the hot gases G flowing through the working passage P so as to prevent hot gases from passing through third, fourth, fifth and sixth conventional sealing structures 304-307 between the first disk 100 and the second row of vanes $V_2$, between the first row of blades $B_1$ and the second row of vanes $V_2$, between the second disk 110 and the second row of vanes $V_2$ and between the second row of blades $B_2$ and the second row of vanes $V_2$.

The second delivery structure 250 further comprises, in the illustrated embodiment, two second delivery passageways 254 extending from the second plenum 240 for providing a portion of low pressure cooling fluid to a first inner cavity 262 located between the first and second disks 100 and 110, see FIGS. 2, 7, 11 and 12. Each second delivery passageway 254 is defined by a second delivery bore 120D provided in the support shaft 120 and a second delivery bore 110D provided in the second disk 110, see FIGS. 3-5 and 7. In the illustrated embodiment, the second delivery passageways 254 have a diameter of about 30 mm. The low pressure cooling air delivered by the second delivery passageways 254 cools an inner section of the second outer surface 101B of the first disk 100 and an inner section of the first outer surface 111A of the second disk 110.

The second delivery structure 250 also comprises, in the illustrated embodiment, two third delivery passageways 256 extending from the second plenum 240 for providing a portion of the low pressure cooling fluid to a second inner cavity 264 between the second disk 110 and the support shaft 120, see FIGS. 2, 9, 11 and 12. Each third delivery passageway 256 is defined by a third delivery bore 120E provided in the support shaft 120, see FIGS. 3-5 and 9. In the illustrated embodiment, the third delivery passageways 256 have a diameter of about 30 mm. The low pressure cooling air delivered by the third delivery passageways 256 cools an inner section of the second outer surface 111B of the second disk 110 and a first outer surface 121A of the support shaft 120.

Figure 8:
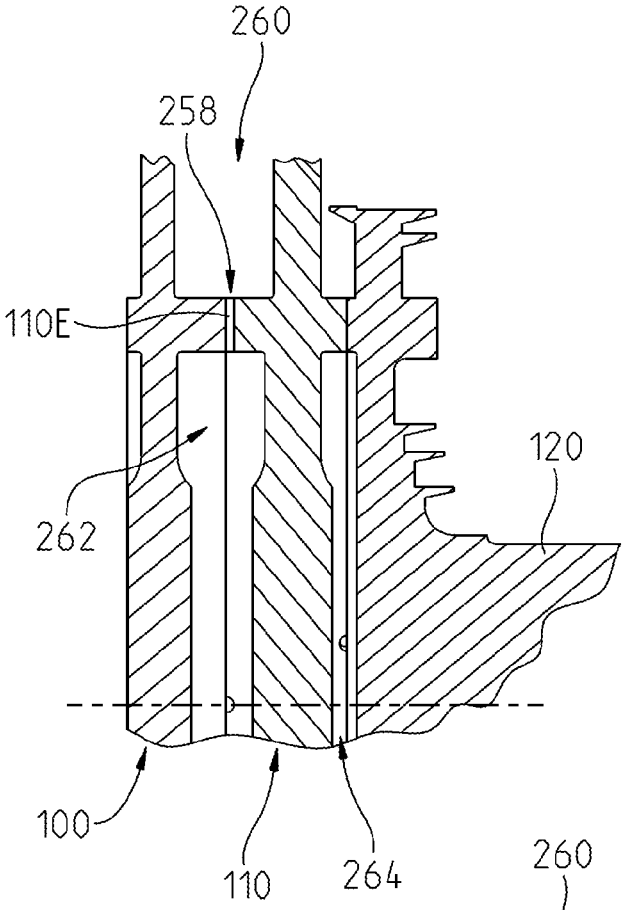
FIG. 8 is a view taken along view line 8-8 in FIG. 3.
Figure 9:
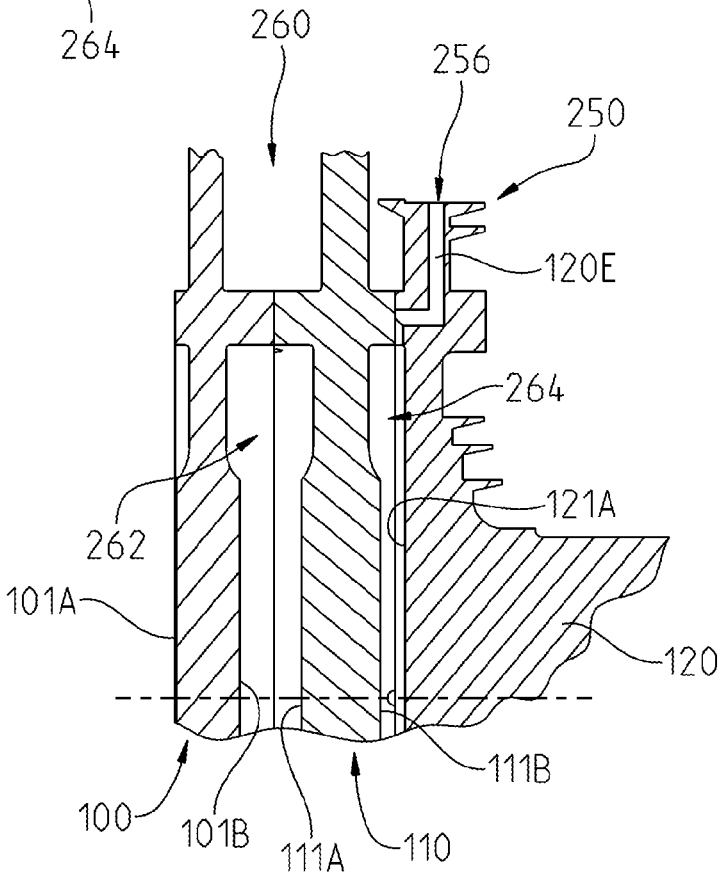
FIG. 9 is a view taken along view line 9-9 in FIG. 3.

The second delivery structure 250 still further comprises two first exit passageways 258 extending between the first inner cavity 262 and the first outer cavity 260 so as to provide a path for cooling fluid in the first inner cavity 262 to travel or exit to the first outer cavity 260, see FIG. 8. Each first exit passageway 258 is defined by a third delivery bore 110E provided in the second disk 110, see FIGS. 4 and 8. In the illustrated embodiment, the first exit passageways 258 have a half moon shape and a diameter of about 30 mm.

Figure 10:
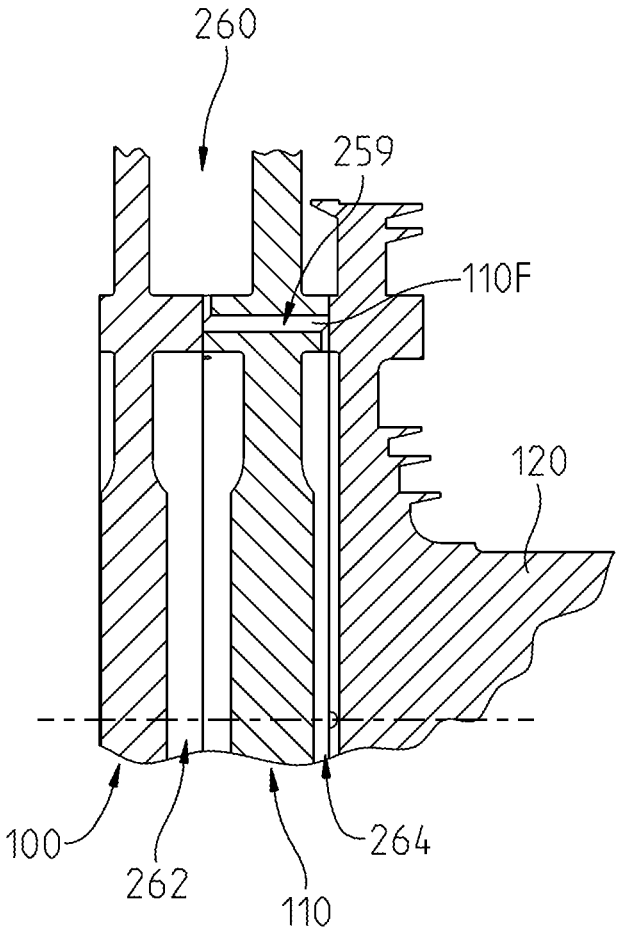
FIG. 10 is a view taken along view line 10-10 in FIG. 3.

The second delivery structure 250 also comprises two second exit passageways 259 extending between the second inner cavity 264 and the first outer cavity 260 so as to provide a path for cooling fluid in the second inner cavity 264 to travel or exit to the first outer cavity 260, see FIG. 10. Each second exit passageway 259 is defined by a fourth delivery bore 110F provided in the second disk 110, see FIGS. 3, 4 and 10. In the illustrated embodiment, the second exit passageways 259 have a half moon shape and a diameter of about 30 mm.

In an alternative embodiment, it is contemplated that the second plenum 240 could be formed elsewhere such as within the first sealing structure 213.

While an embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A power turbine receiving cooling fluid from compressor apparatus comprising:

fixed housing structure;

a support shaft rotatably supported in said housing structure;

first and second disks overhung on said support shaft and coupled to said support shaft so as to rotate with said support shaft, said first and second disks being formed from a low-alloy-content steel;

a first plenum defined between said fixed housing structure and a radially extended section of said support shaft, said first plenum receiving a first stage cooling fluid;

a second plenum defined between said fixed housing structure and said radially extended section of said support shaft, said second plenum located radially outward from said first plenum and receiving a second stage cooling fluid; and cooling fluid supply structure supplying said first and second stage cooling fluid and including structure extending through said support shaft and at least said second disk so as to supply cooling fluid from said second plenum to at least one cavity between said first and second disks.

2. The power turbine as set out in claim 1, wherein said low-alloy-content steel comprises AISI 4340 steel.

3. The power turbine as set out in claim 1, further comprising a plurality of circumferentially spaced apart bolts for coupling said first and second disks to said support shaft.

4. The power turbine as set out in claim 1, wherein said cooling fluid supply structure comprises:

at least one first convey conduit extending to said fixed housing structure for providing said first stage cooling fluid from a first stage of said compressor apparatus to said fixed housing structure;

at least one first supply passage in said fixed housing structure through which the first stage cooling fluid passes to said first plenum; and first delivery structure formed in said support shaft and said first and second disks so as to provide the first stage cooling fluid to at least one of said first and second disks.

5. The power turbine as set out in claim 4, wherein said first plenum extends circumferentially about 360 degrees.

6. The power turbine as set out in claim 5, wherein said first delivery structure comprises a plurality of circumferentially spaced apart delivery passages extending from said first plenum through said support shaft, said second disk and said first disk to a first outer surface of said first disk, facing in a direction away from said second disk, for providing the first stage cooling fluid to said first outer surface of said first disk.

7. The power turbine as set out in claim 5, further comprising first and second sealing structures associated with said fixed housing structure and said support shaft for sealing said first plenum.

8. The power turbine as set out in claim 7, wherein said first and second sealing structures comprise first and second labyrinth sealing structures.

9. The power turbine as set out in claim 4, wherein said cooling fluid supply structure further comprises:

at least one second convey conduit extending to said fixed housing structure for providing said second stage cooling fluid from a second stage of said compressor apparatus to said fixed housing structure;

at least one second supply passage in said fixed housing structure through which the second stage cooling fluid passes to said second plenum; and second delivery structure formed in said support shaft and said first and second disks so as to provide the second stage cooling fluid to at least one of said first and second disks.

10. The power turbine as set out in claim 9, wherein said second plenum extends circumferentially about 360 degrees.

11. The power turbine as set out in claim 10, wherein said second delivery structure comprises:

at least one first delivery passageway extending from said second plenum for providing a portion of the second stage cooling fluid to a first outer cavity between said first and second disks; and at least one second delivery passageway extending from said second plenum for providing a portion of the second cooling fluid to a first inner cavity between said first and second disks.

12. The power turbine as set out in claim 11, wherein said second delivery structure further comprises at least one third delivery passageway extending from said second plenum for providing a portion of the second stage cooling fluid to a second inner cavity between said second disk and said support shaft.

13. The power turbine as set out in claim 12, wherein said second delivery structure further comprises:

at least one first exit passageway extending between said first inner cavity and said first outer cavity so as to provide a path for cooling fluid in said first inner cavity to travel to said first outer cavity; and at least one second exit passageway extending between said second inner cavity to said first outer cavity so as to provide a path for cooling fluid in said second inner cavity to travel to said first outer cavity.

14. The power turbine as set out in claim 10, further comprising a third sealing structure provided between said fixed housing structure and said support shaft, said second and third sealing structures sealing said second plenum.

15. The power turbine as set out in claim 14, wherein said third sealing structure comprises a third labyrinth sealing structure.

16. The power turbine as set out in claim 9, wherein the first stage cooling fluid is provided at a higher pressure than the second stage cooling fluid.

17. A power turbine receiving cooling fluid from compressor apparatus comprising:

fixed housing structure;

a support shaft rotatably supported in said housing structure;

first and second disks overhung on said support shaft and coupled to said support shaft so as to rotate with said support shaft, said first and second disks being formed from a low-alloy-content steel;

a first plenum defined between said fixed housing structure and a radially extended section of said support shaft, said first plenum receiving a first stage cooling fluid;

a second plenum defined between said fixed housing structure and said radially extended section of said support shaft, said second plenum located radially outward from said first plenum and receiving a second stage cooling fluid; and cooling fluid supply structure supplying said first and second stage cooling fluid and comprising a plurality of circumferentially spaced apart passages extending through said support shaft and at least said second disk so as to supply cooling fluid from said second plenum to at least one cavity between said first and second disks.

18. The power turbine as set out in claim 17, wherein said low-alloy-content steel comprises AISI 4340 steel.

* * * * *